United States Patent [19]

Kuna et al.

[11] 4,139,967

[45] Feb. 20, 1979

[54] AMUSEMENT SET

[75] Inventors: Wayne A. Kuna, Elmhurst; Palmer J. Schoenfield; Gordon A. Barlow, both of Evanston, all of Ill.

[73] Assignee: Marvin Glass & Associates, Chicago, Ill.

[21] Appl. No.: 767,395

[22] Filed: Feb. 14, 1977

[51] Int. Cl.[2] ..... A63H 33/00

[52] U.S. Cl. ..... 46/12; 46/11

[58] Field of Search ..... 46/11, 12, 13, 68, 19, 46/18, 20, 21, 116

[56] References Cited

U.S. PATENT DOCUMENTS

| | | | |
|---|---|---|---|
| D. 169,888 | 6/1953 | Beyer | 46/12 X |
| 2,413,152 | 12/1946 | Dell | 46/19 |
| 2,969,609 | 1/1961 | Kowalski | 46/68 X |
| 3,182,420 | 5/1965 | Bender | 46/12 |
| 3,650,064 | 3/1972 | Fusco | 46/12 |
| 3,719,001 | 3/1973 | Archer | 46/12 |
| 3,888,039 | 6/1975 | Snyder et al. | 46/12 |
| 4,030,235 | 6/1977 | Terzian et al. | 46/11 |

*Primary Examiner*—Russell R. Kinsey
*Assistant Examiner*—Mickey Yu
*Attorney, Agent, or Firm*—Mason, Kolehmainen, Rathburn & Wyss

[57] ABSTRACT

An amusement set for use particularly by children comprises a carrying case having a pair of mating hollow housing members which are hingedly attached together to open and close along a peripheral seam line. Preferably, each of the housing members is formed of integrally molded plastic material and includes a bottom wall, an outer side wall and a top wall which are shaped to form the outside wall and roof structure of a toy castle. A handle is provided for the carrying case including a band which is formed in a loop and pivotally attached to one of the housing members for movement between an upright position for use in transporting the case and its contents and a generally horizontal position wherein the band forms the wall of a lookout tower for a tree house. The amusement set includes one or more toy figurines representing fictional play characters such as are developed in the theme of a television show for children and the like. The housing members are pivotal between a closed position and an open position ready for play and the characters are manipulated in and around the opened members during play.

14 Claims, 7 Drawing Figures

AMUSEMENT SET

BACKGROUND OF THE PRESENT INVENTION

A. Field of the Invention

This invention relates to amusement devices for children and more particularly, to an amusement set comprising a carrying case for containing one or more toy figurines representing fictional play characters. The carrying case is formed by a pair of cooperating, hinged together, hollow housing members which are shaped to resemble the walls, bottom and roof structure of a toy castle and the characters are suitable for manipulation within and about the toy castle when the housing members are opened.

B. Description of the Prior Art

Children's amusements sets and the like have been well received by the public and a variety of different themes have been developed but as far as it is known, there has not been developed a comprehensive amusement set with a carrying case having an outer profile resembling the wall and roof structure of a toy castle and building with internal rooms and with one or more separate, readily manipulated toy figurine characters resembling fictional characters of a show or television theme.

SUMMARY OF THE INVENTION

The present invention comprises a new and improved amusement set (particularly designed for use by young children) having a carrying case formed with a pair of mating hollow housing members which are hingedly interconnected to open and close along a peripheral seam line. Each of the housing members includes a bottom wall, an outer side wall and a top wall which are shaped to form and resemble the outer wall and roof structure of a toy castle and building. A handle for carrying the closed case includes a band formed in a loop and pivotally attached to one of the housing members for pivotal movement between an upright position used in transporting the carrying case and its contents and a generally horizontal or lower position wherein the band forms the wall of a lookout tower adjacent the tree house roof structure. One or more toy figurines representing fictional play characters dimensioned in scale with the toy castle are provided for playful manipulation within and around the open case which forms a castle and the rooms thereof and these play characters are developed in accordance with the theme of a television series or programs designed for children of tender years.

One of the features of the amusement set includes a dividing wall of one housing member which forms a floor, roof or wall segment between a pair of vertically spaced upper and lower rooms, which segment is provided with an opening for communication between the rooms. A helically spiralled pole extends between the upper and lower rooms through the opening and a support platform is mounted on the pole for carrying one of the toy figurines. The platform is movable up and down along the spiralled pole through the opening and can travel from one room to the other. The pole is formed of a strip of non-circular transverse cross-section and the support platform is keyed to the strip to rotate relative thereto on upward or downward movement to simulate a rotating descending or ascending elevator platform.

Another feature of the amusement set resides in an arrangement wherein a separate cylindrical hollow room enclosure is mounted on a segment of a top wall having an opening therein and the room cylinder is secured on the wall for relative rotation by hand manipulation. A similar spiralled pole is provided between the hollow room cylinder and a separate lower room formed in the housing below the opening. A turntable is mounted on the pole within the lower room for relative longitudinal and rotational movement along the spiral pole. By winding or rotating the hollow room cylinder, the turntable which is limited against rotation relative to the lower room is made to raise or lower on the pole and any number of toy figurines may be carried on the turntable as desired.

The walls of the carrying case formed by the cooperating housing members have openings therein and in one feature, a door is hingedly attached to open and close a door opening at an upper level. A floor platform is connected to the door for supporting a toy figurine for view from the outside of the toy castle structure when the door is opened. Integrally formed steps are molded on the castle walls leading up to the platform both on the external and the internal surface of the adjacent side wall structure.

Yet another feature of the amusement set is a lower door opening with a pair of doors positioned one above the other with one door having a floor platform for supporting a toy figurine movable outwardly through the door opening when the door is opened. An upper door is pivotal to an open position independently of a lower door and is adapted to be opened automatically when the lower door is opened. In addition, a mail slot is provided in a wall adjacent a door opening and the slot is opened and blocked off upon opening and closing movement of a door.

DESCRIPTION OF THE PREFERRED EMBODIMENT

Figure 1:
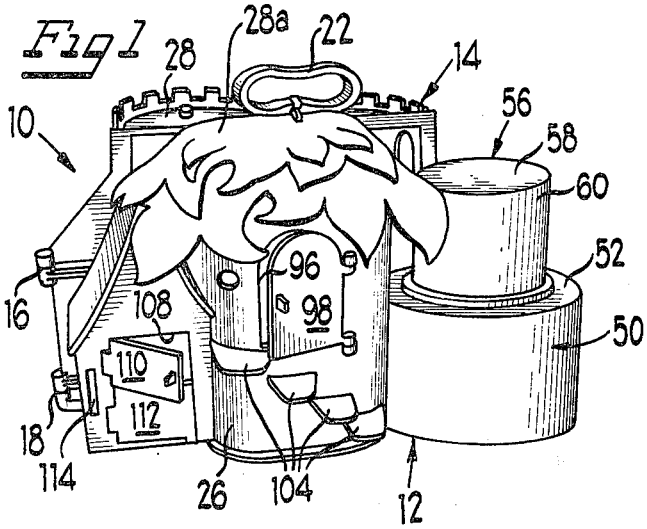
FIG. 1 is a front elevational view of a closed carrying case of an amusement set constructed in accordance with the features of the present invention with the handle shown in an upstanding position for transporting the case and its contents.
Figure 2:
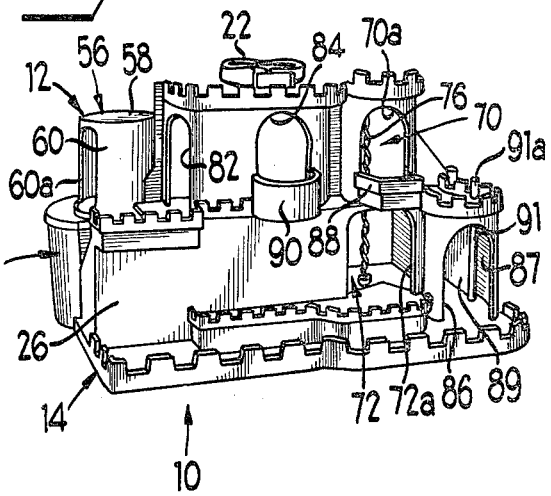
FIG. 2 is a rear perspective elevational view of the carrying case of FIG. 1 with the handle shown in a downward or horizontal position forming a peripheral wall for a lookout tower of a tree house structure. The walls of the carrying case are designed and shaped to resemble a toy castle.
Figure 3:
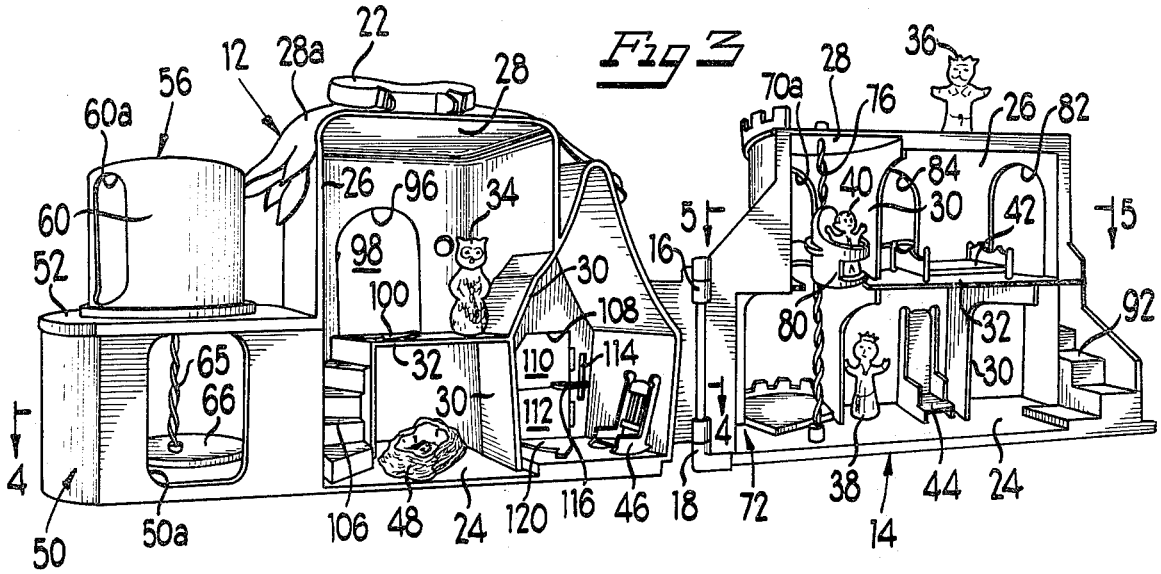
FIG. 3 is a perspective elevational view illustrating the carrying case of FIG. 1 with the hinged together housing members or halves opened up to expose the interior rooms and divisions thereof in the toy castle so that the amusement set and the toy figurines may be manipulated and used by a child in play.

Referring now more particularly to the drawings, an amusement set in accordance with the present invention and particularly adapted for use by children of tender years includes a carrying case generally indicated in FIGS. 1 and 2 by the reference numeral 10. The carrying case includes a pair of mating, hollow housing members 12 and 14 preferably formed of integrally molded plastic material and hingedly interconnected together at one end along a vertical pivot axis by a pair of integrally formed hinge pin and socket assemblies 16 and 18 respectively. The housing members 12 and 14 are adapted to pivot between a closed configuration as shown in FIGS. 1 and 2 and an open configuration ready for play as shown in FIG. 3 wherein the hollow interior portions of the housing members are exposed and accessible. The outer surface of the housing members is shaped and designed to resemble the walls and roof structure of a toy castle and are of quite irregular shape and these members are profiled to interfit closely with one another to form a closed seam when the carrying case is closed for transport with its contents as shown in FIGS. 1 and 2. The housing members meet one another when closed on a matching perimeter lying on a seam plane represented in FIGS. 4 and 5 by the reference numeral 20.

In accordance with a feature of the present invention, the carrying case 10 is provided with a loop type handle 22 formed of a bland of molded plastic material which is pivotally mounted adjacent an upper roof portion of the housing member 12 for movement between an upstanding position, as shown in FIG. 1, suitable for use in carrying the closed case 10 and a downward or horizontal position as shown in FIG. 2, wherein the handle forms the side or parapet wall of a lookout tower on the top portion of the tree house. Each of the housing members 12 and 14 are formed with a relatively flat base, bottom wall or floor 24 which serves as the first floor of the toy castle building structure. In addition, each housing member is provided with an irregularly shaped, more or less continuous side wall structure 26 extending upwardly of the floor and forming exterior wall portions of castle rooms which are provided within the interior of each housing member. Each housing member also includes an upper or top wall structure 28 joined with the side wall and forming the roof structure of the toy castle. As shown in FIGS. 1 and 3, a portion of the top wall structure on the housing member 12 is formed to resemble tree leaves 28*a* and the handle 22 forms a lookout tower for this tree. In addition to the bottom wall, the outer side walls and the top walls as described, the housing members are provided with integrally formed internal dividing walls 30 as best shown in FIG. 3, which internal walls divide the interior of the housing members into a plurality of lower level and upper level rooms as described in more detail hereinafter and as depicted in the drawings.

In accordance with the present invention, the amusement set 10 includes one or more toy figurines representing fictional play characters which may be manipulated and played with by a child by movement and placement of the characters in and around the toy castle structure and the immediate environment. These fictional characters may be developed along the theme of a children's television series or story and the decor of the toy castle may likewise be colored, shaped and designed to represent the desired theme around the play characters. For example, the toy figurines may include an owl 34 (FIGS. 3 and 6), a king and queen character 36 and 38 and a baby or prince character 40 shown in FIGS. 3 and 7. In addition, various articles of furniture such as a bed 42, a throne 44, rocking chair 46, and an owl's nest 48, are provided in the amusement set for playful manipulation within the rooms or area around the toy castle structure. The play characters are dimensionally scaled to be compatible with the two story castle structure of the carrying case 10 and the characters are readily movable within and between the various rooms in the open array as shown in FIG. 3 through various openings and doors provided in the internal and external wall structure.

Figure 4:
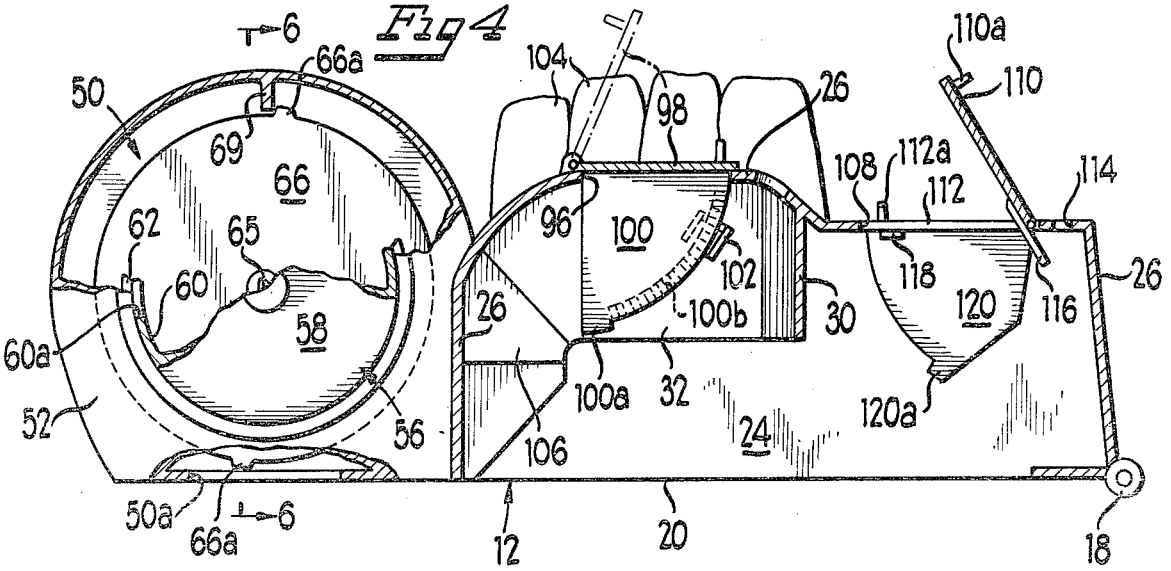
FIG. 4 is a horizontal sectional view taken substantially along lines 4—4 of FIG. 3.

Referring now more particularly to FIGS. 1, 3, 4 and 6, the housing member 12 is formed with a lower room structure on the left hand end as viewed in FIGS. 3 and 4 of a generally cylindrical shape and referred to by the numeral 50. The room 50 is provided with an annular upper wall or ceiling 52 formed with a large circular opening 54 at the center. A cylindrical, second story, hollow room enclosure designated by the numeral 56 is rotatively mounted on the annular ceiling 52 above the lower room and this upper level room includes a circular top wall 58 integral with a cylindrical side wall 60. At the lower end, the side wall 60 is provided with an outwardly extending annular lip 62 which is seated within an annular recess formed in an upstanding mounting ring integrally formed on the upper surface of the ceiling 52. The upper room 56 is freely rotatable by hand manipulation about a vertical center axis extending between the upper and lower rooms.

Figure 6:
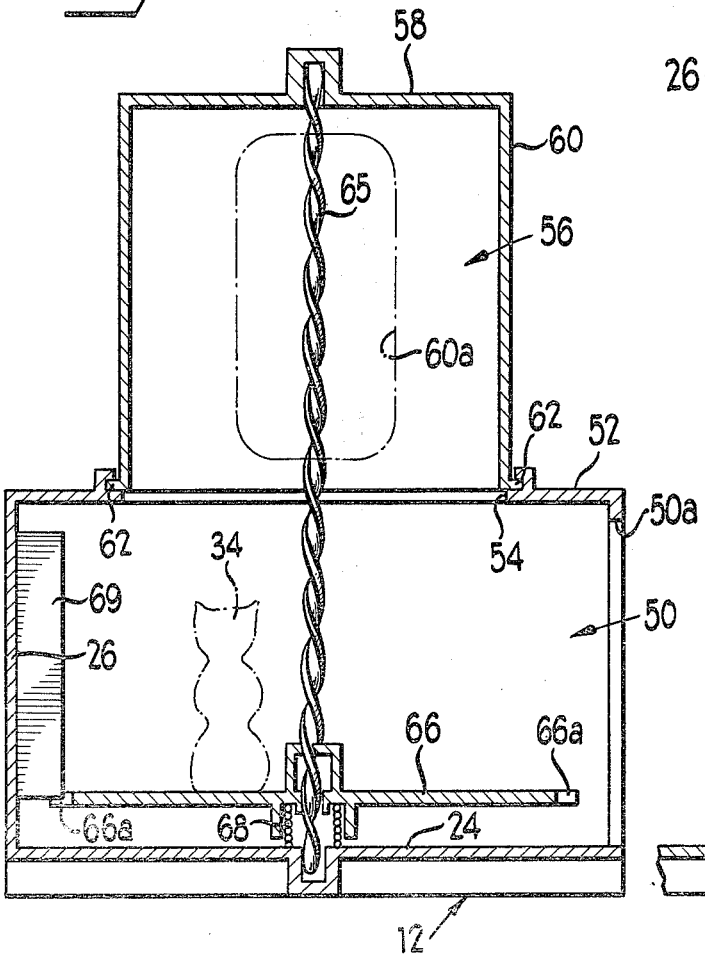
FIG. 6 is a vertical transverse sectional view taken substantially along lines 6—6 of FIG. 4.

As best shown in FIG. 6, an elongated pole 65 is fixedly connected at its upper end to the circular top wall 58 and the pole extends downwardly through the circular opening 54 into the lower room 50 where the lower end of the pole is received in a central recess form in the bottom wall 24 of the housing 12. The pole is formed of a strip of helically, spiralled sheet metal or the like and the strip is of a non-circular transverse cross-section. A circular turntable 66 is mounted on the pole which extends through a slot at the center thereof to provide a keying action between the turntable and the spiral turns of the pole. Accordingly, as the upper room 56 is manually rotated in one direction or the other, the pole 65 is similarly rotated about its longitudinal axis and the turntable 66 may be moved upwardly or downwardly on the pole above the floor 24 dependent upon the direction of relative rotation.

A coil spring 68 is mounted on the underside of turntable 66 between the underside of the circular turntable and the upper surface of the floor 24 and this coil spring normally biases the turntable upwardly on the pole toward the annular ceiling 52. Rotation of the turntable 66 within the room 50 is limited by engagement of one of a pair of diametrically opposed radial extension lugs 66*a* integrally formed on the outer periphery of the turntable. These lugs move into rotation limiting stopping engagement with a vertical rib 69 inwardly extending from and integrally formed on the inside wall surface of the lower room 50. The rib is radially aligned with the axis of the spiral pole 65 and its lower end terminates a distance above the floor 24 while its upper end terminates a distance below the ceiling 52. As the turntable level changes in the room 50 and the lugs 66*a* on the outer edge of the turntable either move above the upper end of the rib 69 or below the lower end of the rib, the turntable is free to rotate. When the turntable 66 is at a level intermediate the end of the vertical rib 69, rotation of the turntable is limited by engagement of a lug 66*a* with the rib and the turntable can only move up or down as the pole is rotated in the room 50. In the position as shown in FIG. 6, the spring 68 is effective to bias the turntable upwardly while one of the lugs 66a engages the rib and prevents rotation of the turntable. As the pole is rotated by manipulation of the upper room 56 the turntable rises until the underside reaches a level above the upper end of the rib. At this time, the turntable may rotate downward freely until rotation is opposed when the opposite lug 66a engages vertical rib 69, thereby preventing turntable 66 from ever engaging the underside of the annular ceiling wall 52 of the lower room 50. In this position the turntable 66 forms the floor for the upper room 56. The upper room is provided with a relatively large opening 60a in the cylindrical side wall 60 and various ones of the play characters and figurines may be easily passed through the opening 60a, into and out of the upper room. Manually turning the upper room formed by the cylindrical side wall 60 in a direction opposite to the direction that brought it up, causes the turntable to rotate freely downward disengaging lug 66a until rotation is opposed by the opposite lug 66a engaging the vertical rib. At this time, the turntable, with its rotation limited continues down until the spring 68 begins to compress. As the top surface of the lug 66a passes under the lower end of the rib 69, to a level where the turntable is biased upward by spring 68, the turntable moves upward until rotation is again opposed by the opposite lug 66a engaging the rib thereby preventing turntable 66 from ever engaging floor 24 of the lower room 50. The opening 60a in the cylindrical side wall of the upper room permits the play characters to be externally viewed as they descend downwardly on the turntable as the upper room 56 rotates. The lower room 50 is formed with an enlarged opening 50a in the side wall thereof so that play characters on the turntable 66 may be viewed from the outside and may be removed or placed on the turntable as desired.

From the foregoing it will be seen that the turntable 66 is movable up and down along the spiral pole 65 and is rotatable as well in a controlled fashion so that a child playing with the amusement set can use the play characters and the turntable to provide the movement and action described.

Figure 5:
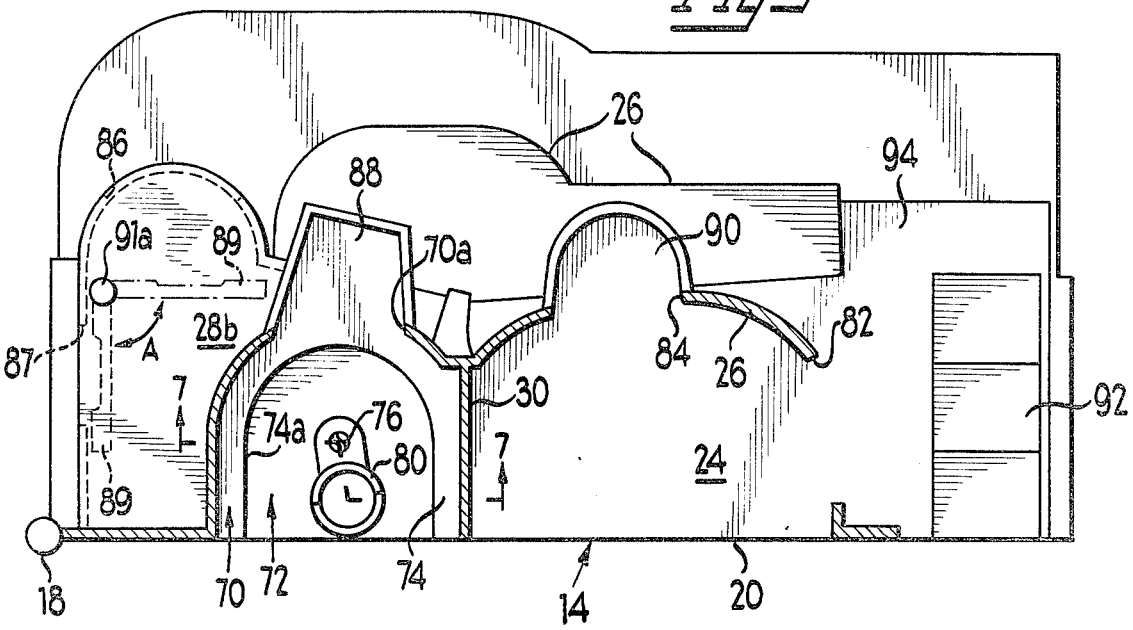
FIG. 5 is a horizontal sectional view taken substantially along lines 5—5 of FIG. 3.
Figure 7:
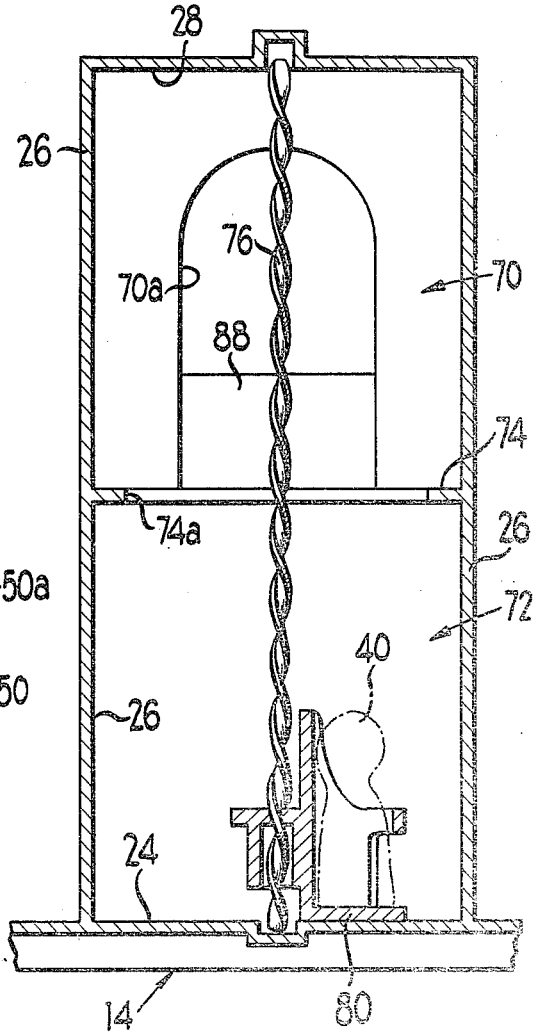
FIG. 7 is a vertical sectional view taken substantially along lines 7—7 of FIG. 5.

In accordance with another feature of the present invention, the housing member 14 is formed with a pair of vertically spaced upper and lower rooms 70 and 72 separated from one another by a second floor structure 74 having a large opening 74a therein as shown in FIGS. 5 and 7. A pole 76, similar to the pole 65 and of non-circular, transverse cross-section and spiralled along its length as shown, extends between the upper and lower rooms through the enlarged opening 74a. The pole is free at both its upper and lower ends to rotate within aligned central recesses formed in the upper wall structure 28 of the upper room 70 and the lower wall or floor structure 24 of the lower room 72. The pole 76 rotates freely relative to the housing structure and an elevator platform 80 is keyed onto the pole to move up or down thereon as desired. The elevator platform is dimensioned to hold at least one of the toy figurine play characters which may be placed and removed therefrom and when the elevator platform is manually moved upwardly on the pole into the upper room 70 and subsequently released, the platform and toy characters thereon will spin around on the pole as they descend from the upper room into the lower room. The outer side wall structure of the housing 14 is formed with a window or door opening 70a to permit the platform and toy characters carried thereon to be viewed from outside the toy castle and the back side of the housing is fully open along the seam plane 20 for clear viewing of the elevator platform and ready manipulation of the play characters. Similarly, the lower room 72 is provided with a large opening 72a in the side wall to permit the interior of the room to be viewed from outside the housing member of the toy castle structure.

The outer side wall of the housing member 14 is formed with several additional openings 82, 84 and 86 to permit the interior of the rooms in the housing structure to be viewed from outside and balconies 88 and 90 are formed in front of the openings 70a and 84, respectively, to hold play characters that may be placed thereon. A stairway 92 is provided at the outer end of the housing member 14 and extends between a room on the lower level of the toy castle structure to an open deck or second story floor level 94. The toy characters may be manipulated up and down the stairway and through the various openings into and out of the rooms and onto the external roof and second floor deck levels as desired by a child during play with the amusement set.

In accordance with the present invention, the housing member 12 is formed with a door opening 96 at the upper or second story level and a manually operable door 98 is hingedly attached to the side wall of the housing adjacent the opening to pivot open and close as best shown in FIGS. 1 and 4. As shown, the outer surface of the door is formed with an integrally molded handle for grasping the door to move it between the closed position shown in solid lines (FIG. 4), and an outwardly open position shown in dotted lines. Integrally formed with the door is an arcuate shaped horizontal floor segment 100 extending inwardly of the door and which provides a platform for supporting one or more of the play characters placed thereon. The platform structure includes a lug or projection 100a on the inner edge, which lug is engageable with an adjacent inside jamb surface around the door opening 96 to thereby limit the outward opening movement of the door and platform. On the underside, the door platform is formed with a plurality of ratchet type teeth (dotted lines) which teeth are engageable with a spring like detent mechanism 102 mounted on the second story interior floor segment 32. Engagement of the ratchet teeth and spring during opening and closing of the door generates a clicking noise or sound that resembles a castle door being opened and closed. When the door is open and a play character is in position on the platform 100, the play character is readily viewable from outside the toy castle through the door opening 96.

On the outer surface of the side wall structure, the housing 12 is provided with a plurality of integrally formed, relatively large steps 104 which lead upwardly from the base level to the upper level of the door platform 100. These steps are dimensioned to accommodate the various play characters that may be placed thereon or moved up and down the stairway. On the interior side wall surface of the housing 12, a central horizontal room is provided with a circular stair case 106 comprising steps leading up to the level of the door platform 100 and the play characters may be moved up and down the stairway for placement on the door platform or the floor structure 32 as shown in FIG. 3.

In accordance with the invention, the outer side wall of the housing 12 is formed with a lower door opening 108 and a pair of vertically spaced doors 110 and 112 are hingedly attached to a jamb edge of the opening for movement between a closed position flush with the outside surface of the toy castle and an open position as shown in FIG. 4. Adjacent the hinged side of the doors, the housing wall is formed with a mail chute or slot 114 and the upper door 110 is provided with an inwardly extending closure member 116 on the inside surface, which member moves into a mail chute closing or blocking position as shown in FIG. 3 when the door is closed. Sliding a mail parcel into mail chute 114 forces the arm 116 out of the way, opening upper door 110 (as if to be answering the mailman). The doors 110 and 112 are provided with integrally formed outside handles 110*a* and 112*a*, respectively, and the upper door is independently openable and closeable with respect to the lower door 112. However, the door 112 includes an upstanding tab 118 on the inside surface which is engageable with the inside surface of the upper door 110 and causes the door to open when the lower door is opened. The door 112 is also provided with a horizontal floor platform 120 extending inwardly thereof for supporting one or more of the play characters for viewing when one or both of the doors 110 and 112 are in an open position. A stop lug 120*a* on the inner edge of the door platform 120 is provided to engage an inside jamb surface of the door opening 108, thereby to limit the opening movement of the door.

It will thus be seen that the amusement set in accordance with the present invention provides a comprehensive play set including a toy castle building structure formed as a carrying case with two mating halves. A plurality of separate toy figurines representing play characters of a particular theme or setting are provided, and in addition, furniture components are also provided. The carrying case with a novel handle structure forming a lookout tower when folded provides an enjoyable and comprehensive form of entertainment for young children not heretofore available.

Referring to FIGS. 2 and 5, the housing member 14 is formed with a first floor room at the hinged end having a relatively large opening 86 on the front wall and an exit opening 87 (as best shown in FIG. 5) on the side wall. This room has a roof or ceiling 28*b* which forms a floor or deck adjacent the balcony structure 88. Inside the room is provided a fireplace wall 89 carried on a vertical pole 91 extending between the bottom wall or floor 24 and upwardly through the ceiling 28*b*. The pole is formed with a knob portion 91*a* above the roof deck 28*b* so that the fireplace wall 89 may be pivoted as shown by the arrow "A" from a first position parallel of the seam plane 20 wherein the fireplace opening faces to the front or outside and is viewable from the front opening 86 and a second position normal thereto wherein the exit opening 87 in the side wall of the building is closed off.

Although the present invention has been described with reference to a single illustrative embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. An amusement set, comprising:

a carrying case having a pair of mating hollow housing members hingedly connected to open and close along a peripheral seam line, each of said housing members including a bottom wall, an outer side wall, and a top wall shaped to form the outside wall and top structure of a toy castle;

a handle for said carrying case including a band formed in a loop and pivotally attached to one of said housing members for movement between an upright position for use in transporting said case and a generally horizontal position wherein said band forms the wall of a lookout tower for a tree house of said toy castle;

a door opening formed in the outer side wall of at least one of said housing members, a door pivotally secured to open and close with respect to said door opening, and floor platform means secured to extend inwardly of said door in said door opening for supporting one or more toy figures thereon representing play characters for manipulation in and around said toy castle;

a second door pivotally secured to open and close with respect to said door opening spaced about said first door and movable to open and close independently thereof;

wherein one of said housing members is formed with a male slot adjacent said door opening and one of said doors includes means for opening and closing said male slot from inside said housing member when one door is opened and closed.

2. An amusement set, comprising:

a carrying case having a pair of mating hollow housing members hingedly connected to open and close along a peripheral seam line, each of said housing members including a bottom wall, an outer side wall, and a top wall shaped to form the outside wall and top structure of a toy castle;

a handle for said carrying case including a band formed in a loop and pivotally attached to one of said housing members for movement between an upright position for use in transporting said case and a generally horizontal position wherein said band forms the wall of a lookout tower for a tree house of said toy castle;

a door opening formed in the outer side wall of at least one of said housing members, a door pivotally secured to open and close with respect to said door opening, and floor platform means secured to extend inwardly of said door in said door opening for supporting one or more toy figures thereon representing play characters for manipulation in and around said toy castle; and sounding means operatively associated with said floor platform for generating sound when said door is open.

3. An amusement set, comprising:

a carrying case having a pair of mating hollow housing members hingedly connected to open and close along a peripheral seam line, each of said housing members including a bottom wall, an outer side wall, and a top wall shaped to form the outside wall and top structure of a toy castle;

a handle for said carrying case including a band formed in a loop and pivotally attached to one of said housing members for movement between an upright position for use in transporting said case and a generally horizontal position wherein said band forms the wall of a lookout tower for a tree house of said toy castle;

a door opening formed in the outer side wall of at least one of said housing members, a door pivotally secured to open and close with respect to said door opening, and floor platform means secured to extend inwardly of said door in said door opening for supporting one or more toy figures thereon representing play characters for manipulation in and around said toy castle; and stop means for limiting the outward travel of said platform means through said door opening when said door is opened.

4. An amusement set, comprising:

a carrying case having a pair of mating hollow housing members hingedly connected to open and close along a peripheral seam line, each of said housing members including a bottom wall, an outer side wall, and a top wall shaped to form the outside wall and top structure of a toy castle;

a handle for said carrying case including a band formed in a loop and pivotally attached to one of said housing members for movement between an upright position for use in transporting said case and a generally horizontal position wherein said band forms the wall of a lookout tower for a tree house of said toy castle; and at least one toy figure representing a fictional play character dimensioned in scale with said castle for manipulation within and around said housing members of said toy castle, wherein at least one of said housing members includes a top wall segment having a roof opening therein above a room in said toy castle, a hollow room enclosure mounted on said toy wall segment above said opening secured for relative rotative movement thereon, a pole extending between said housing room enclosure and said room below said roof opening, turntable means for supporting one or more of said toy figures and mounted on said pole for relative longitudinal and rotational movement between an upper level adjacent said roof opening and a lower level in said room.

5. The amusement set of claim 4 wherein said pole comprises an elongated helically spiralled strip of non-circular transverse cross-section and wherein said turntable means is keyed to said pole, one of said poles secured to rotate with said hollow room enclosure whereby amnual rotation of said room enclosure raises and lowers said turntable means on said pole.

6. The amusement set of claim 5 including stop means for limiting relative rotation of said turntable means in said room below said roof opening.

7. An amusement set, comprising:

a carrying case having a pair of mating hollow housing members hingedly connected to open and close along a peripheral seam line, each of said housing members including a bottom wall, an outer side wall, and a top wall shaped to form the outside wall and top structure of a toy castle;

a handle for said carrying case including a band formed in a loop and pivotally attached to one of said housing members for movement between an upright position for use in transporting said case and a generally horizontal position wherein said band forms the wall of a lookout tower for a tree house of said toy castle; and dividing wall means in at least one of said housing members forming a plurality of separate rooms in said toy castle, said dividing wall means including a floor segment above said bottom wall forming one pair of vertically spaced upper and lower rooms in said castle, said floor segment including an opening defined therein for communicating between said upper and lower rooms, a pole extending between said rooms through said opening, and means for supporting a toy character mounted on said pole for relief to move downwardly under gravity influence from said upper room to said lower room through said opening in said floor segment.

8. The amusement set of claim 7 wherein said pole comprises an elongated helically spiral strip of non-circular transverse cross-section and said support means is keyed to said strip to rotate relative thereto on downward movement after release above said bottom wall.

9. The amusement set of claim 8 wherein said pole extends between said bottom wall and a top wall of said one housing member forming a roof of said toy castle, an upper end of said pole engaging top wall and supported thereby for free rotation whereby said pole may spin about a vertical axis as said supporting means carrying a toy character thereon is released to descend downwardly on said pole toward said bottom wall.

10. The amusement set of claim 7 wherein said upper room is formed with a window in said outer side wall of said one housing member permitting said support means and a toy figurine placed thereon to be viewed during movement along said pole from said upper room toward said lower room.

11. The amusement set of claim 10 wherein said lower room is formed with a window in said outer side wall of said one housing member permitting said support means and a toy figurine placed thereon to be viewed during movement on said pole into said lower room.

12. An amusement set, comprising:

a carrying case having a pair of mating hollow housing members hingedly connected to open and close along a peripheral seam line, each of said housing members including a bottom wall, an outer side wall, and a top wall shaped to form the outside wall and top structure of a toy castle;

a handle for said carrying case including a band formed in a loop and pivotally attached to one of said housing members for movement between an upright position for use in transporting said case and a generally horizontal position wherein said band forms the wall of a lookout tower for a tree house of said toy castle;

a door opening formed in the outer side wall of at least one of said housing members, a door pivotally secured to open and close with respect to said door opening, and floor platform means secured to extend inwardly of said door in said door opening for supporting one or more toy figures thereon representing play characters for manipulation in and around said toy castle; and said door opening means spaced above said bottom wall of said one housing member and said platform means being at a level of a second story room in said toy castle and including step means leading up to said platform means from said lower first story floor level.

13. The amusement set of claim 12 wherein said step means are integrally formed on the inside surface of said outer side wall of said one housing member and are dimensioned to support said toy figurines thereon.

14. The amusement set of claim 12 wherein said step means are integrally formed on the outside surface of said outer side wall and are dimensioned to support said toy figurines thereon.

* * * * *